United States Patent [19]

Brandly

[11] 4,363,295

[45] Dec. 14, 1982

[54] MOVABLE HEAD ENGINE

[76] Inventor: Ernest B. Brandly, 900 S. A St., Suite 314, Richmond, Ind. 47374

[21] Appl. No.: 185,742

[22] Filed: Sep. 10, 1980

[51] Int. Cl.[3] ..... F02B 25/10

[52] U.S. Cl. ..... 123/51 AA; 123/51 BA; 123/56 C; 123/197 A

[58] Field of Search ..... 123/51 R, 51 A, 51 AA, 123/51 B, 51 BA, 197, 56 C

[56] References Cited

U.S. PATENT DOCUMENTS

| | | | |
|---|---|---|---|
| 1,666,709 | 4/1928 | Loud | 123/197 R |
| 1,973,887 | 9/1934 | Schick | 123/51 AA |
| 2,153,899 | 4/1939 | Shover | 123/51 AA |
| 2,170,058 | 8/1939 | Larkin | 123/51 AA |
| 2,494,890 | 1/1950 | Mallory | 123/51 BA |
| 2,541,594 | 2/1951 | Mallory | 123/51 BA |

FOREIGN PATENT DOCUMENTS

| | | | |
|---|---|---|---|
| 45433 | 10/1917 | Sweden | 123/51 A |

*Primary Examiner*—Craig R. Feinberg

*Attorney, Agent, or Firm*—Jenkins, Coffey, Hyland, Badger & Conard

[57] ABSTRACT

An internal combustion engine utilizing either an Otto or a Diesel cycle contains two opposed pistons in each cylinder. The first piston drives a crank arm which drives a crankshaft. The crankshaft, through a timing means, drives an eccentric positive-motion cam which drives a movable cylinder head piston. The positive-motion cam drives the movable cylinder head piston via two roller followers, placed on opposite sides of the axis of rotation of the cam. The first piston functions as a driving piston. The movable cylinder head piston changes the volume in the cylinder between the pistons as a function of the movement and position of the first piston.

5 Claims, 7 Drawing Figures

MOVABLE HEAD ENGINE

This invention relates to movable head internal combustion engines.

The concept of a movable head engine is not new. Among the prior U.S. patents describing movable head engines are: Bronander U.S. Pat. No. 1,432,320; Wolf U.S. Pat. No. 1,914,707; Schick U.S. Pat. No. 1,973,887; Shover U.S. Pat. No. 2,153,899; Zachery U.S. Pat. No. 4,010,611; and Tryhorn U.S. Pat. No. 4,092,957.

Bronander's, Zachery's, and Tryhorn's devices utilize movable head pistons for extracting power from fuel combustion. Each piston is connected to a crankshaft and drives the crankshaft. Schick employs a cam groove and follower arrangement to drive a movable head piston. Wolf employs an eccentric cam to move a spring-biased lever. The lever is connected to a connecting rod which is connected to the movable head piston. The spring biases the piston into a retracted position and the cam actuates the lever and crank rod, moves the piston down into the cylinder, and returns to a retracted position before the drive piston reaches bottom dead center. In one embodiment, Wolf uses a cam follower to actuate a spring-biased rocker arm which connects to a crank arm which connects to the movable head piston. In another embodiment, Wolf employs a crankshaft and not a cam. Shover employs a cam groove and follower system.

The instant invention improves upon these previous designs. In the structures of the present invention, the movable head is not spring-urged or pushrod-driven. It is moved positively by a cam and roller follower mechanism which does not require cutting of a groove in the face of a cam plate. Since the movable head piston is stationary during the period of fuel combustion, all of the force generated by combustion goes to move the drive piston. The engine design can be adapted to several different engine valve configurations with very little tooling. Because of the engine design, detonation has no detrimental effect on engine components. The engine design permits the crankshaft to be made less massive. The eccentric cam which operates the movable head piston can be ground to give almost 100% volumetric efficiency. The design in this engine results in less internal friction per horsepower developed, and provides more torque per amount of fuel consumed. This engine can be used to produce hydrogen through the coal slurry and electrolysis process. The use of this engine in this process reduces the amount of electricity required to produce a given amount of hydrogen.

According to the invention, combustion in a cylinder of a fuel-air mixture drives a piston. The piston drives a crank arm of a crankshaft through a connecting rod. The crankshaft synchronously rotates a camshaft through a suitable timing means. A positive-motion cam of the camshaft is shaped to maintain constant contact with two roller followers throughout its revolution. The roller followers are connected to a second piston which serves as a movable cylinder head. The interaction of the roller followers and the positive motion cam reciprocate the movable head piston between a maximum projected position and a maximum retracted position. By timing the maximum compression of the fuel-air mixture to coincide with combustion of the fuel-air mixture, and also with a crankshaft position in which the force exerted on the crankshaft by the crank arm can most efficiently translate piston reciprocation into crankshaft rotation, this invention increases the power obtained from an internal combustion engine. Power is further increased by driving the movable head piston through a cam and roller-follower arrangement whereby less energy is expended in driving the movable head.

The invention is shown in the context of a one-cylinder engine. The invention can readily be adapted to multiple cylinder engines.

The invention may best be understood by referring to the following description and accompanying drawings which illustrate the invention. In the drawings.

Figure 1:
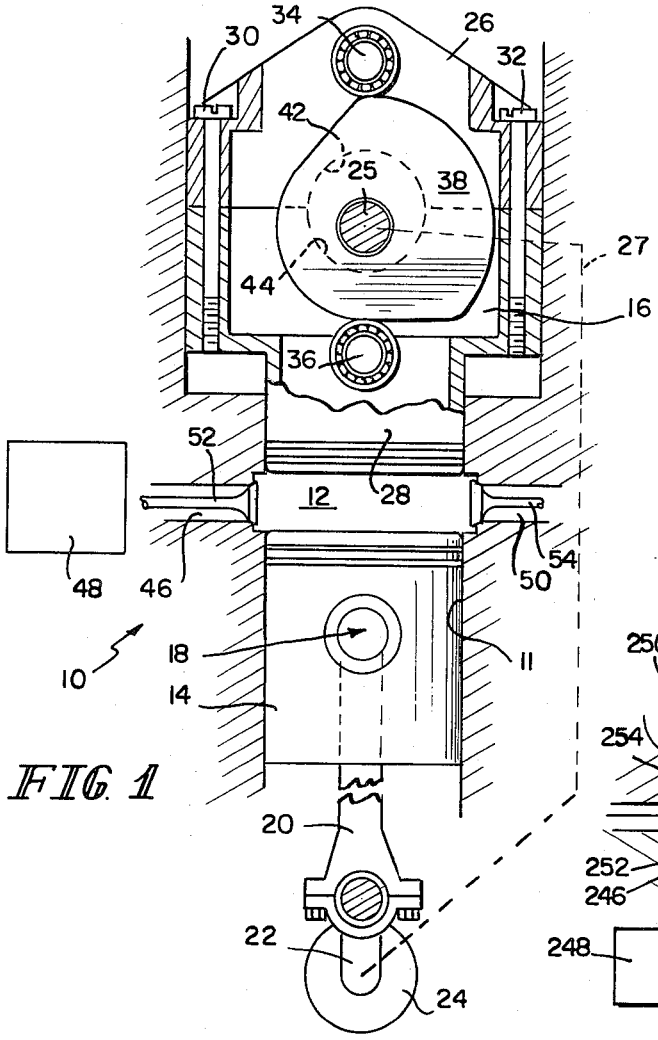
FIG. 1 is a longitudinal section through a cylinder of an engine transverse to the crankshaft axis, illustrating the parts of the invention at the point where the driving piston is at the top dead center position, and providing a fragmentary view of the movable head piston to expose the cam housed within.

Referring to FIG. 1, a cylinder 10 defined by a cylinder wall 11 contains a combustion chamber 12 which is defined by the space in the cylinder between a drive piston 14 and a movable head piston 16. The drive piston 14 is coupled through a wrist pin 18 and a connecting rod 20 to a crank arm 22 of a crankshaft 24. Reciprocating movement of the drive piston 14 rotates the crankshaft 24. A timing mechanism 27 (shown schematically), such as two identical timing gears and a timing chain, couples crankshaft 24 to a camshaft 25. The movable head piston consists of an upper portion 26 housing an upper roller follower 34 and a lower portion 28 housing a lower roller follower 36. Portions 26, 28 are attached together by cap screws 30, 32. Movable head piston 16 houses a positive-motion cam 38 provided on camshaft 25. The movement of the cam 38 is synchronized with the crankshaft 24 by the timing mechanism 27. The positive-motion cam 38 is shaped so as to maintain constant contact with both the upper roller follower 34 and the lower roller follower 36 throughout its revolution, to reciprocate the movable head piston 16 between a maximum projected position in chamber 12 and a maximum retracted position in chamber 12 by its movement against the upper and lower roller followers 34, 36, respectively. The upper and lower portions 26, 28, respectively, of the movable head piston 16 contain openings 42, 44, respectively, which cooperate to form a clearance opening around camshaft 25 to prevent interference between the piston 16 and the camshaft 25.

An intake port 46 of suitable design is coupled to an air and fuel induction device 48, such as a carburetor or fuel-injection device. An exhaust port 50 of suitable design conducts exhaust gases away from the combustion chamber 12. Ports 48, 50 are controlled by intake and exhaust valves 52, 54, respectively, which are actuated by conventional valve timing cams, not shown.

The illustrated cylinders are Diesel cycle cylinders, in which no spark plug is necessary. In an Otto cycle engine, a spark plug is necessary to ignite the fuel-air mixture. The spark plug can be located in the combustion chamber and driven from a distributor or magneto in accordance with known principles.

Figure 2:
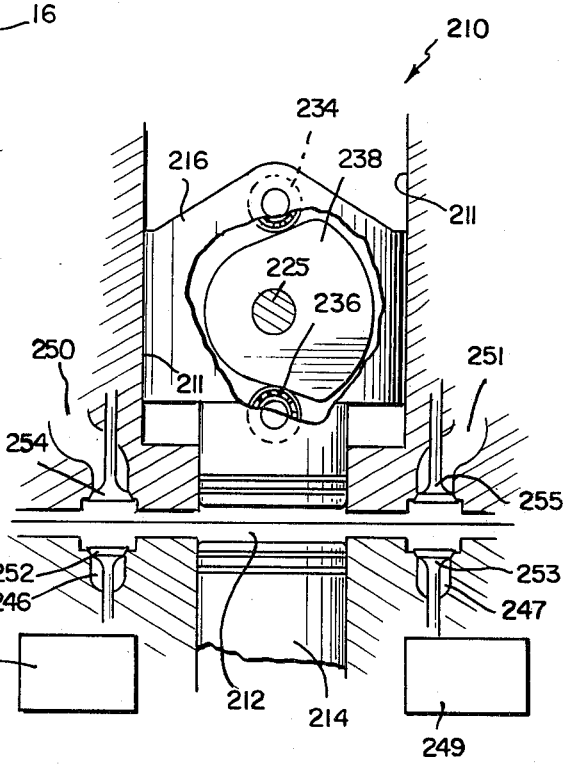
FIG. 2 is a longitudinal section through a cylinder, similar to FIG. 1, and showing the engine design adapted to a different valve arrangement.
Figure 3:
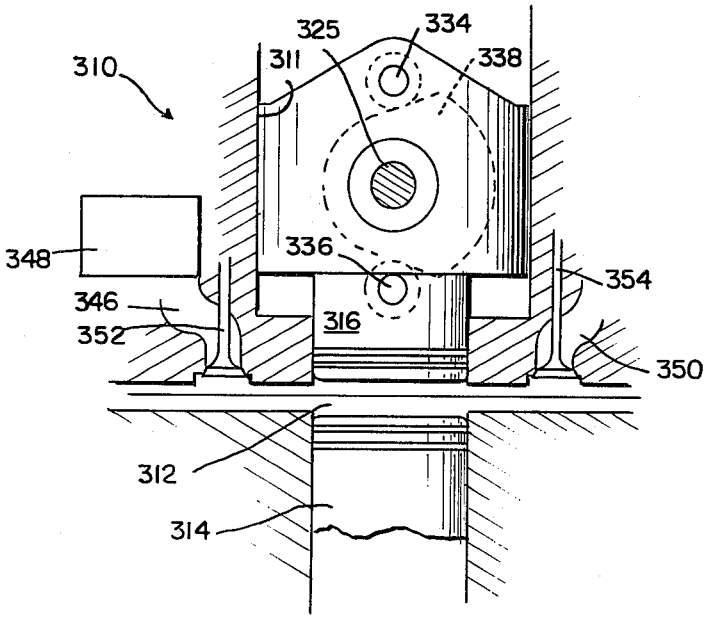
FIG. 3 is a longitudinal section through a cylinder, similar to FIG. 1, and showing the engine design adapted to a different valve arrangement.

FIGS. 2 and 3 show the invention as adapted to different valving arrangements.

Referring now to FIG. 2, most of the major components shown, such as the drive piston 214, positive-motion cam 216, camshaft 225, and upper and lower roller followers 234 and 236, respectively, are unchanged over FIG. 1. Twin fuel-air intake ports 246, 247 are coupled to air and fuel induction devices 248, 249, such as carburetors or fuel injector devices. In some embodiments of the engine, it may be preferred to couple both intake ports 246, 247 to the same air and fuel induction devices, and thus eliminate the need for one of the two air and fuel induction devices 248, 249. Twin exhaust ports 250, 251 of suitable design conduct exhaust gases away from the combustion chamber 212. Intake ports 246, 247 are controlled by intake valves 252, 253, respectively. Exhaust ports 250, 251 are controlled by exhaust valves 254, 255, respectively. The valves 252, 253, 254, and 255 are actuated by conventional valve timing cams, not shown. Valves 252, 253, 254, and 255 reciprocate parallel to the drive piston 214 and movable head piston 216. Since the valve 252, 253, 254, and 255 placement in FIG. 2 is different than the valve 52, 54 placement of FIG. 1, the combustion chamber 212 of FIG. 2 is of a different configuration than the combustion chamber 12 of FIG. 1.

Referring to FIG. 3, the major components, such as the drive piston 314, positive-motion cam 316, camshaft 325, and upper and lower roller followers 334 and 336, respectively, are unchanged over FIGS. 1 and 2, although the valving arrangement differs in FIG. 3. A single intake port 346 and exhaust port 350, controlled by a single intake valve 352 and exhaust valve 254, are used in the cylinder 310 of FIG. 3. Like FIG. 2, and unlike FIG. 1, the valves in FIG. 3 reciprocate parallel to the drive piston 314 and the movable head piston 316. The combustion chamber 312 of FIG. 3 is of a different configuration than the combustion chamber 12 of FIG. 1 and the combustion chamber 212 of FIG. 2.

The operation of the engine can best be understood with reference to FIGS. 4–7.

In the following operational description, the directions clockwise and counterclockwise refer to those directions relative to the axis of the crankshaft 424 as viewed in FIGS. 4–7. In the embodiment described, both the crankshaft 424 and the camshaft 425 rotate in a clockwise direction. The shape of the positive-motion cam 438, however, provides the same engine performance if the camshaft 425 rotates in a direction opposite to the crankshaft 424. The timing means employed between the crankshaft and camshaft is not crucial to this invention, and for certain timing means, opposite rotation may well be the preferred embodiment. Although the cycle described below relates to two-cycle operation, the invention is easily adaptable to four-cycle operation.

Figure 4:
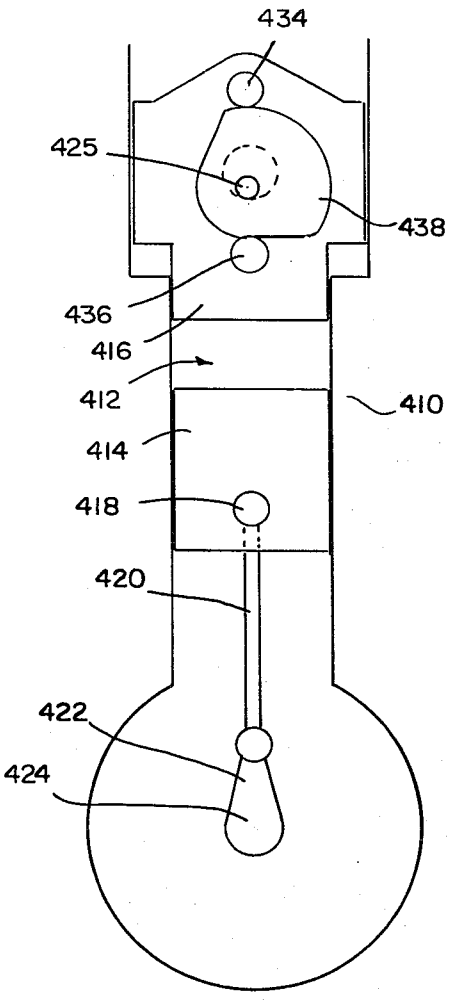
FIG. 4 is a longitudinal section of a cylinder with the drive piston and crankshaft at the top dead center position.

In FIG. 4, a cylinder 410 and its component parts are shown at the beginning of a cycle. The crank arm 422 is at top dead center or zero degrees into its cycle. The crank arm 422 fully projects the connecting rod 420 which fully projects the drive piston 414 into the cylinder 410. At this point, the drive piston 414 is at its maximum projected position. The crankshaft 424, crank arm 422, and connecting rod 420 are positioned so that subsequent movement will retract the drive piston 414 out of the cylinder 410. The camshaft 425 positions the positive motion cam 438 about the upper and lower roller followers 434 and 436, respectively, so as to place the movable head piston 416 in a position of maximum retraction out of the cylinder 410. The camshaft 425 and the positive-motion cam 438 are positioned so that subsequent movement of the camshaft 425 will cause the cam 438 to act through the lower roller follower 436 and project the movable head piston 16 into the cylinder 410. At this point in the cycle, the combustion chamber 412 is at its minimum volume in the cycle.

Figure 5:
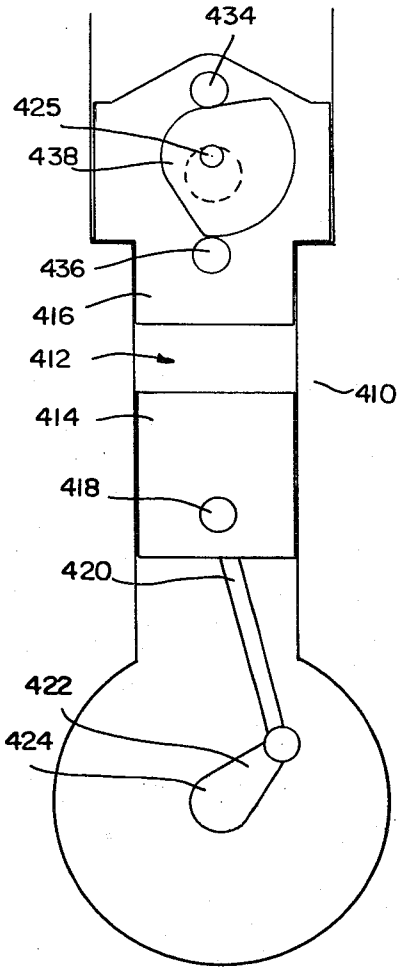
FIG. 5 is a longitudinal section of a cylinder with the drive piston and crankshaft positioned at 45° from top dead center, showing the position at which combustion of the fuel takes place, and showing the movable head piston fully reciprocated toward the drive piston.

FIG. 5 illustrates cylinder 410 and its component parts at the position in the cycle at which combustion of the fuel-air mixture occurs. The crankshaft 424 has rotated in a clockwise direction 45° past top dead center. The crankshaft 424 through the crank arm 422 and the connecting rod 420 has pulled the drive piston 414 to a partially retracted position. Simultaneously, the camshaft 425 has rotated 45°. Through its clockwise movement, the camshaft 425 has moved the positive motion cam 438. Through the lower roller follower 436, the positive motion cam 438 has projected the movable head piston 416 into the cylinder 410 to the movable head piston 416 point of maximum projection into the cylinder 410. The volume of the combustion chamber 412 is the same as it was when the crankshaft 424 was at the top dead center position (FIG. 4), i.e., the combustion chamber 412 is also at a point of minimum volume when the crankshaft 424 is advanced 45° from the crankshaft 424 top dead center position.

At this point (FIG. 5) in the cycle, fuel is injected and/or ignited. The combustion of the fuel-air mixture expands the gas contained within the combustion chamber 412 of the cylinder 410, and drives the drive piston 414 and hence the crank arm 422 and crankshaft 424 to the bottom dead center position (FIG. 6), which is 180° past top dead center.

Figure 6:
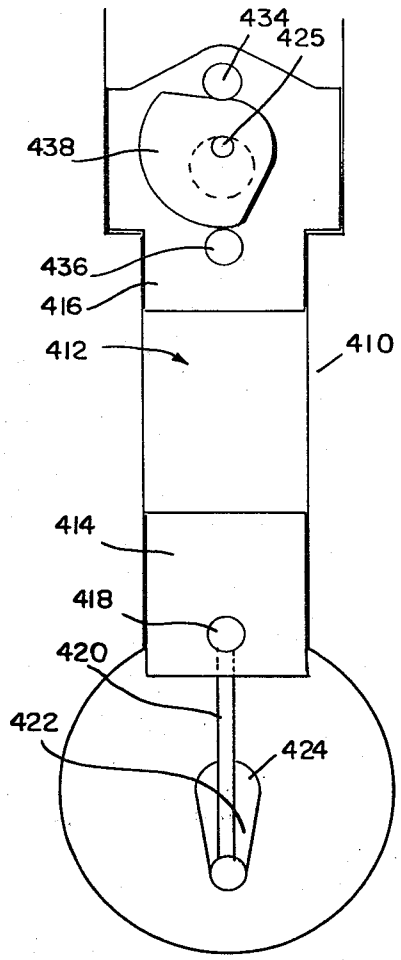
FIG. 6 is a longitudinal section of a cylinder with the drive piston and crankshaft positioned at bottom dead center, showing the movable head piston fully reciprocated toward the drive piston.

FIG. 6 illustrates a cylinder and its component parts at the bottom dead center position. At this point in the cycle, the drive piston 414 is at its point of maximum retraction out of the cylinder. Simultaneously, the camshaft 425 has rotated the positive motion cam 438 180° past top dead center. The shape of the positive motion cam has held the movable head piston 416 at its fully projected position throughout the entire time that the expansion of the gas caused by the burned fuel in the combustion chamber 412 drives the piston 414 to the bottom dead center position.

Figure 7:
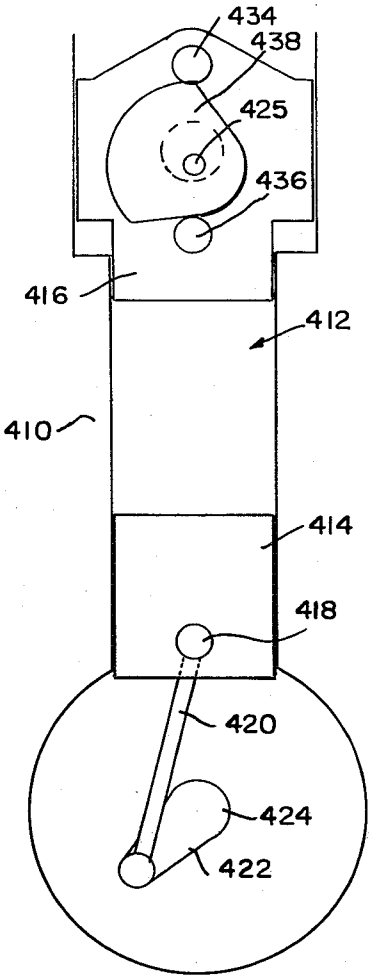
FIG. 7 is a longitudinal section of a cylinder with the drive piston and crankshaft at about 45° past bottom dead center, showing the movable head piston fully reciprocated away from the drive piston.

FIG. 7 shows cylinder 410 with the crankshaft 424 rotated 45° past bottom dead center (225° past top dead center). The rotation of the crankshaft 424 through the crank arm 422 and the connecting rod 420 projects the drive piston 414 into the cylinder. This projection continues until the crankshaft 424 has rotated to the top dead center position. Simultaneously, the camshaft 425 has rotated the positive-motion can 45° past bottom dead center (225° past top dead center). The positive-motion cam 438 has pushed on the upper roller follower 434, which has moved the movable head piston 416 to its position of maximum retraction. Just as the positive-motion cam 438 holds the movable head piston 416 in its position of maximum projection (FIGS. 5 and 6) from a point in the cycle 45° past top dead center to bottom dead center (180° past top dead center), the positive-motion cam 438 also holds the movable head piston 416 in its position of maximum retraction (FIGS. 7 and 4) from 45° past bottom dead center (225° past top dead center) to top dead center (0°). The cycle then repeats itself.

I claim:

1. An internal combustion engine including a cylinder having means for the intake of fuel and air, means for the exhaust of combustion by-products, a reciprocable drive piston in said cylinder, a crankshaft, a connecting rod connecting said piston to said crankshaft, a camshaft, means for synchronizing the movement of the camshaft with the crankshaft, a single cam provided on said camshaft, a movable cylinder head piston reciprocally mounted in said cylinder in opposed relation to said drive piston, said movable head piston having separable upper and lower portions, and having a roller follower on each portion of said movable cylinder head piston, said roller followers being disposed within said movable cylinder head piston on opposite sides of the axis of rotation of said camshaft, movement of said camshaft in engagement with said roller followers causing reciprocating movement of said movable cylinder head piston wherein said movable cylinder head piston is projected toward said drive piston during at least and substantially for 45° of camshaft rotation, is held at a point of maximum projection during at most and substantially for 135° of camshaft rotation, is retracted during at least and substantially for 45° of camshaft rotation, and is held at a point of maximum retraction during at most and substantially for 135° of camshaft rotation.

2. The invention of claim 1 in which the movable head piston and drive piston cooperate to define within said cylinder a minimum combustion chamber volume at a point at which the crankshaft is past top dead center.

3. The invention of claim 1 wherein said roller followers maintain constant contact with said cam throughout each cycle of the engine.

4. The invention of claim 1 or 3 wherein said cam pushes against one said roller follower to project said movable cylinder head piston toward said drive piston and pushes against the other said roller follower to retract said cylinder head piston from said drive piston.

5. The invention of claims 1 or 3 in which maximum pressure resulting from the combustion of fuel and air occurs at a point past top dead center but before bottom dead center of the crankshaft.

* * * * *